US006836552B1

(12) United States Patent
Bachmann et al.

(10) Patent No.: US 6,836,552 B1
(45) Date of Patent: Dec. 28, 2004

(54) PANEL LOUDSPEAKERS

(75) Inventors: Wolfgang Bachmann, Grevenbroich (DE); Gerhard Krump, Schwarzach (DE); Hans-Jürgen Regl, Regensburg (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 0 days.

(21) Appl. No.: 09/719,279

(22) PCT Filed: May 14, 1999

(86) PCT No.: PCT/EP99/03307

§ 371 (c)(1),
(2), (4) Date: Feb. 12, 2001

(87) PCT Pub. No.: WO99/65273

PCT Pub. Date: Dec. 16, 1999

(30) Foreign Application Priority Data

Jun. 10, 1998 (DE) ..... 198 25 866

(51) Int. Cl.[7] ..... H04R 1/00; H04R 25/00

(52) U.S. Cl. ..... 381/431; 381/152; 381/337; 381/423

(58) Field of Search ..... 381/431, 386, 381/396, 401, 402, 412, 411, 421, 423, 424, 420, 409, 398, 152, 337; 181/198, 199, 157, 166

(56) References Cited

U.S. PATENT DOCUMENTS 3,247,925 A 4/1966 Warnaka
3,347,335 A 10/1967 Watters et al.

(List continued on next page.)

FOREIGN PATENT DOCUMENTS

| | | |
|---|---|---|
| DE | 2850956 C2 | 9/1988 |
| DE | 2932942 C2 | 6/1989 |
| DE | 3907540 A1 | 12/1989 |
| EP | 0 924 959 A2 | 6/1999 |
| EP | 0 924 960 A2 | 6/1999 |
| EP | 1086606 B1 | 4/2002 |
| WO | WO 92/03024 | 2/1992 |
| WO | WO 97/09842 | 3/1997 |

*Primary Examiner*—Rexford Barnie
(74) *Attorney, Agent, or Firm*—Foley Hoag LLP

(57) ABSTRACT

The invention relates to the embodiment of so-called panel loudspeakers working according to the bending wave principle. Said panels are generally formed by a panel (11), at least one driver (12) and a frame (13), the panel (11) being connected to the frame (13). In order to achieve appropriate bending wave induction in the panel (11), very complicated assessments must be made in order to determine the corresponding positioning areas (15) in which the driver (12) excites the panel (11) or is connected to the latter. Furthermore, the size of the panels (11) can change considerably depending on the application so that assessments must only be made repeatedly in the case of panels that can be easily modified. The invention aims at providing general positioning areas (15) for the driver (12) in or on the panels (11) so that no further assessments need to be carried out regarding the positioning area (15). To this end, an edge area (16) attached directly to the edges (13) of the panel (11) and a center of gravity area (17) extending along the center of gravity (S) of the panel (11) are discarded from the very beginning as positioning area (15). Specifications with respect to the width or enlargement of the different zones (16, 17) in relation to the dimension of the panel (11) are also given.

22 Claims, 2 Drawing Sheets

U.S. PATENT DOCUMENTS

| | | | | | |
|---|---|---|---|---|---|
| 4,252,211 | A | | 2/1981 | Matsuda et al. | 181/166 |
| 4,426,556 | A | | 1/1984 | Saiki et al. | 179/115.5 |
| 5,682,436 | A | | 10/1997 | Sakamoto et al. | 381/196 |
| 6,031,926 | A | * | 2/2000 | Azima et al. | 381/431 |
| 6,160,898 | A | | 12/2000 | Bachmann et al. | 381/425 |
| 6,170,603 | B1 | | 1/2001 | Bachmann et al. | 181/150 |
| 6,275,598 | B1 | | 8/2001 | Bachmann et al. | 381/425 |
| 6,332,029 | B1 | * | 12/2001 | Azima et al. | 381/152 |
| 6,347,149 | B1 | | 2/2002 | Bachmann et al. | 381/396 |
| 6,369,943 | B1 | | 4/2002 | Bachmann et al. | 359/445 |
| 6,494,289 | B1 | | 12/2002 | Bachmann et al. | 181/173 |
| 6,560,348 | B1 | | 5/2003 | Bachmann et al. | 381/425 |
| 6,622,817 | B1 | | 9/2003 | Bachmann et al. | 181/150 |
| 2001/0017927 | A1 | | 8/2001 | Bachmann et al. | 381/395 |
| 2001/0055403 | A1 | | 12/2001 | Bachmann et al. | 381/190 |
| 2003/0147541 | A1 | | 8/2003 | Bachmann et al. | 381/152 |

* cited by examiner

PANEL LOUDSPEAKERS

FIELD OF THE INVENTION

The invention relates to so-called panel loudspeakers operating according to the bending wave principle, in particular to positioning the drivers of panel loudspeakers.

BACKGROUND OF THE INVENTION

Sound reproduction devices that operate according to the bending wave principle are known in the art. Such devices are formed essentially of a sound panel and at least one drive system, wherein oscillations are induced in the sound panel when electrical audio frequency signals are supplied to the drive system(s). According to one feature of this type of sound reproduction device, a "bending wave radiation" is enabled above a lower limit frequency, also referred to as critical frequency, wherein the bending waves in the plane of the respective sound panel cause the sound to be radiated in a direction that is frequency-dependent. In other words, a cross-section through a directional diagram shows a main lobe with a frequency-dependent direction. These conditions are valid for panels and absorbing panels with an infinite surface area. However, the conditions applying to multi-resonance panels (also referred to as distributed mode loudspeaker) which are the subject matter of the present application, are significantly more complex due to severe boundary reflexes. The increased complexity of multi-resonance plates is caused by a plurality of additional main lobes which are superimposed on the so-called main lobe which has a frequency-dependent direction, thereby producing a strongly fanned-out directional diagram which also has a strong frequency-dependence. Typically, the directional diagrams of the multi-resonance plates described herein are on average oriented away from the surface normal. This characteristic has the effect that the surrounding space plays a much greater role in the projection of the sound waves.

The panel of the panel loudspeaker is constructed according to a sandwich principle, in that two opposing surfaces of a very light core layer are connected, for example through an adhesive bond, by a cover layer that is thin compared to the core layer. The material used for the cover layer should have a particularly high dilatational wave velocity to enhance the sound reproduction characteristic of the panel loudspeaker. Suitable materials for the cover layers are, for example, thin metal foils or fiber-reinforced plastic foils. The core layer also has to meet certain requirements since this layer should have a very small mass density (e.g., 20 to 30 kg/m$^3$). In addition, the core layer should be able to sustain high shear forces perpendicular to the cover layers. Consequently, the elasticity modulus perpendicular to the cover layers has to be sufficiently large, whereas parallel to the cover layers even a very small elasticity module is not detrimental. The characteristic of the core layer can hence be either anisotropic or isotropic. Ultra light core layer structures that have proven successful in practice, are, for example, honeycomb structures made of light metal alloys or resin-impregnated fiber-reinforced paper (anisotropic) as well as rigid expanded foams (isotropic).

In addition, DE-A-197 57 098 discloses a panel connected with a frame, with the frame receiving the panel and providing a connection with other components. Depending on the specific implementation, the frame can also be formed by a mounting wall in which the panel is to be integrated. The connection between the panel and the frame is typically designed as an elastic connection which exerts on the oscillating panel either no resistance at all or only a small resistance. Also known are rigid connections wherein the panels are fixedly connected to the frame.

The panels are driven by drivers which—as illustrated in DE-A-197 57 097—are either located on the respective panel or integrated with the panel.

It is also known to install drivers in form of, for example, electrodynamic shakers or piezoelectric bending oscillator disks primarily in the center or in close proximity to an outer edge, although an analysis of individual undisturbed oscillation modes of rectangular panels may also suggest other suitable locations. It has proven difficult to optimize the excitation position when taking into account the driver feedback, the large number of, in particular, low-frequency modes and the acoustic contribution of each of oscillations mode at each respective modal frequency. A possible solution may be based on modeling the excitation position by a finite element method in combination with a numerical solution of the acoustic field equations, and with a stochastic variation of the boundary conditions and the exact positions over a range of realistic tolerances. Another solution would be to test in practice random driver positions on finished panel loudspeakers. Both approaches are very complex.

It is therefore an object of the invention to define positioning areas for drivers relative to the surface of the panel, wherein the drivers can be easily and efficiently placed in these positioning areas.

SUMMARY OF THE INVENTION

According to an aspect of the invention the positioning area extends between an edge area, which is immediately adjacent to the edges of the panel in the direction of the center of gravity of the panel, and a center-of-gravity area, which extends around the center of gravity of the panels, then obtainable oscillation modes are efficiently utilized while at the same time eliminating harmful local impedances.

If according to claim 2 the panel is fixedly clamped in the frame, wherein the width B of the edge area should correspond to at least 5% of the diagonal of the panel in order to reduce local impedances. In particular, local impedances are reduced for a fixedly mounted panel if the width B of the edge area is approximately 10% of the diagonal of the panel. To increase the efficiency of the oscillating modes, the center-of-gravity area should have a diameter D of at least 20% of the diagonal of the panel. Smaller values of the diameter super-proportionally exclude oscillating modes for driving the panel.

According to another embodiment of the invention, the panel is connected to the frame by yieldable elements, wherein the center-of-gravity area should be cross-shaped, because the areas which are directly adjacent to the lines bisecting the centers of the edges and the center of gravity of the panel have proven to be inadequate for positioning the drivers.

According to yet another embodiment of the invention, the center-of-gravity area is cross-shaped, so that four positioning areas are obtained. To reduce the effect from the edges of the panel on these positioning areas, these areas should include a reduction in those regions where two respective edges of the panel form a corner.

To completely eliminate the influence of the corners of the panel, the reductions should have a triangular shape, wherein two sides of each triangular-shaped reduction are formed by the inner edges of the edge area and the remaining edges of the triangular reductions are located on a closed continuous line that connects the centers M of the edges.

According to yet another embodiment of the invention the shape of the panel is elongated rather than square, wherein the width of the edges of the panel that have a different length should also be different.

The width B1 of the edge area which extends along the long edges of the panel, is a greater than the width B2 of the edge area which extends along the short edges of the panel.

The width B1 is at least 10% and B2 is at least 5% of the diagonal of the panel.

In order to eliminate the aforedescribed disadvantages and/or to obtain a relatively large area for positioning the drivers, it is not necessary that the two two-dimensional areas that form the cross-shaped center-of-gravity area have the same width.

Instead, it is sufficient if the two two-dimensional areas that extend parallel to the long edges of the panel have a width 3.1 that is larger/equal to 2.5% and the two-dimensional areas that extend parallel to the short edges of the panel have a width 3.2 that is larger/equal to 17% of the diagonal of the panel.

An optimal positioning area for the drivers is provided if the drivers have a distance A1 to the center line M' that extends parallel to the long edges of the panel and a distance A2 to the center line M" that extends parallel to the short edges of the panel.

The distance A1 should be approximately 7% and A2 approximately 14% of the diagonal of the panel.

BRIEF DESCRIPTION OF THE DRAWINGS

It is shown in.

DETAILED DESCRIPTION OF CERTAIN EMBODIMENTS

The invention will now be described in more detail with reference to the figures.

Figure 1:
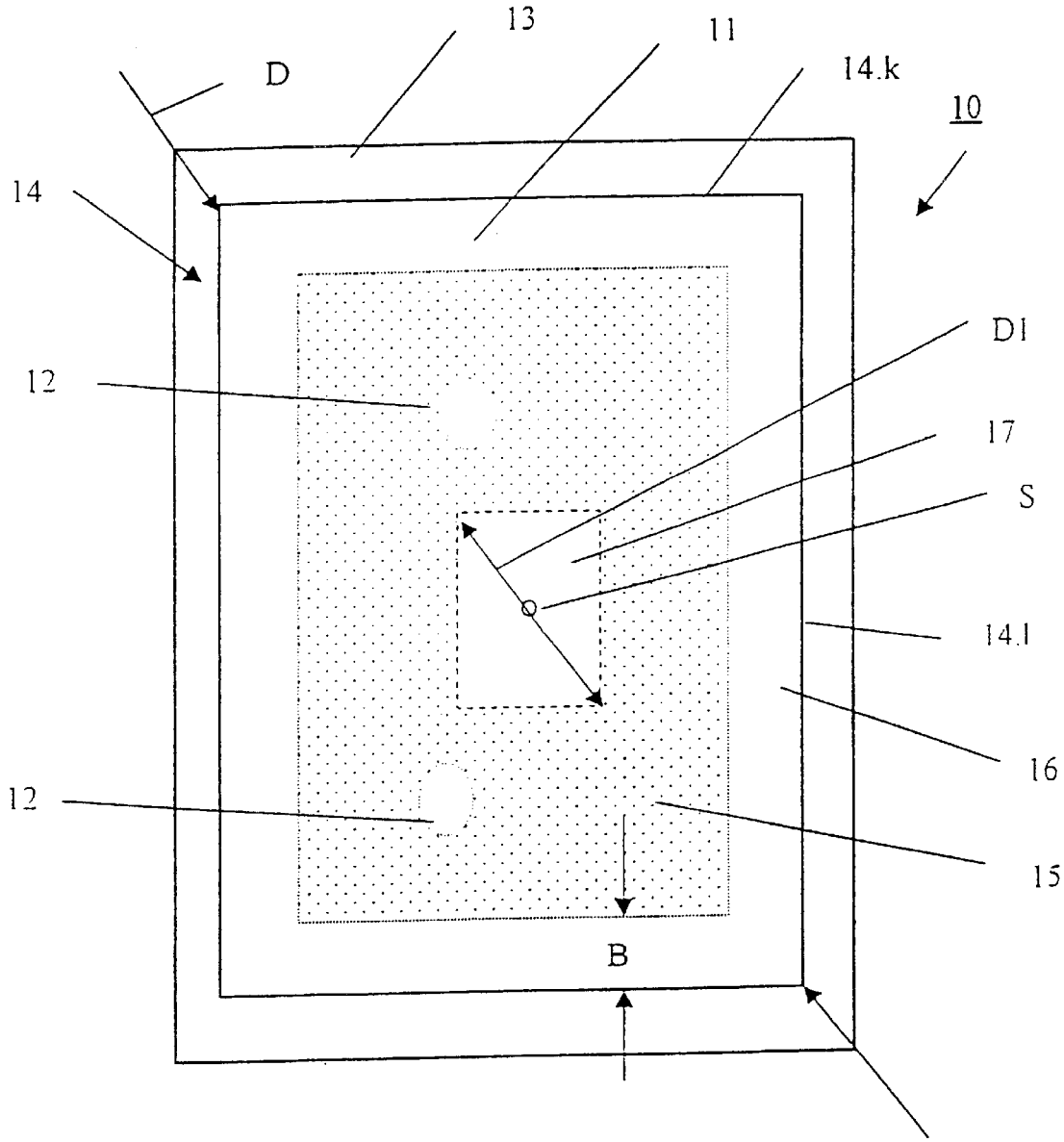
FIG. 1 a top view of a panel loudspeaker.

FIG. 1 is a top view (not to scale) of a panel loudspeaker 10. The panel loudspeaker 10 is essentially formed of a panel 11 constructed in sandwich construction, two drivers 12 and a frame 13. Since the panel 11 in the present embodiment has an elongated shape, the edges have different lengths, namely the long edges 14.l and the short edges 14.k. The edges 14 of the panel 11 are fixedly connected to the frame 13. The drivers 12 are integrated into the panel and are therefore only alluded to in FIG. 1.

The positioning area for the drivers is indicated by the reference numeral 15. For a clearer representation, the positioning area 15 is indicated by a dotted area and extends between an edge area 16 with a width B, which is located immediately adjacent to the edges 14, and a center-of-gravity area 17 having a diameter D1. In the context of the present application, the center-of-gravity area 17 is to be understood as the area of the panel 11 that surrounds the center of gravity S of the panel 11.

The edge area 16 in the present embodiment has a uniform width B of 10% of the diagonal D of the panel 11. In another embodiment (not shown), the edges 14.l, 14.k can have different widths. However, the edge area 16 still should have the greatest possible width B to eliminate local impedances.

In the present example, the center-of-gravity area 17 has a diameter D1 of 25% of the diagonal D of the panel 11. In order to utilize the largest number of oscillations modes for driving the panel 11, the center-of-gravity area 17 should also have the largest possible area.

Figure 2:
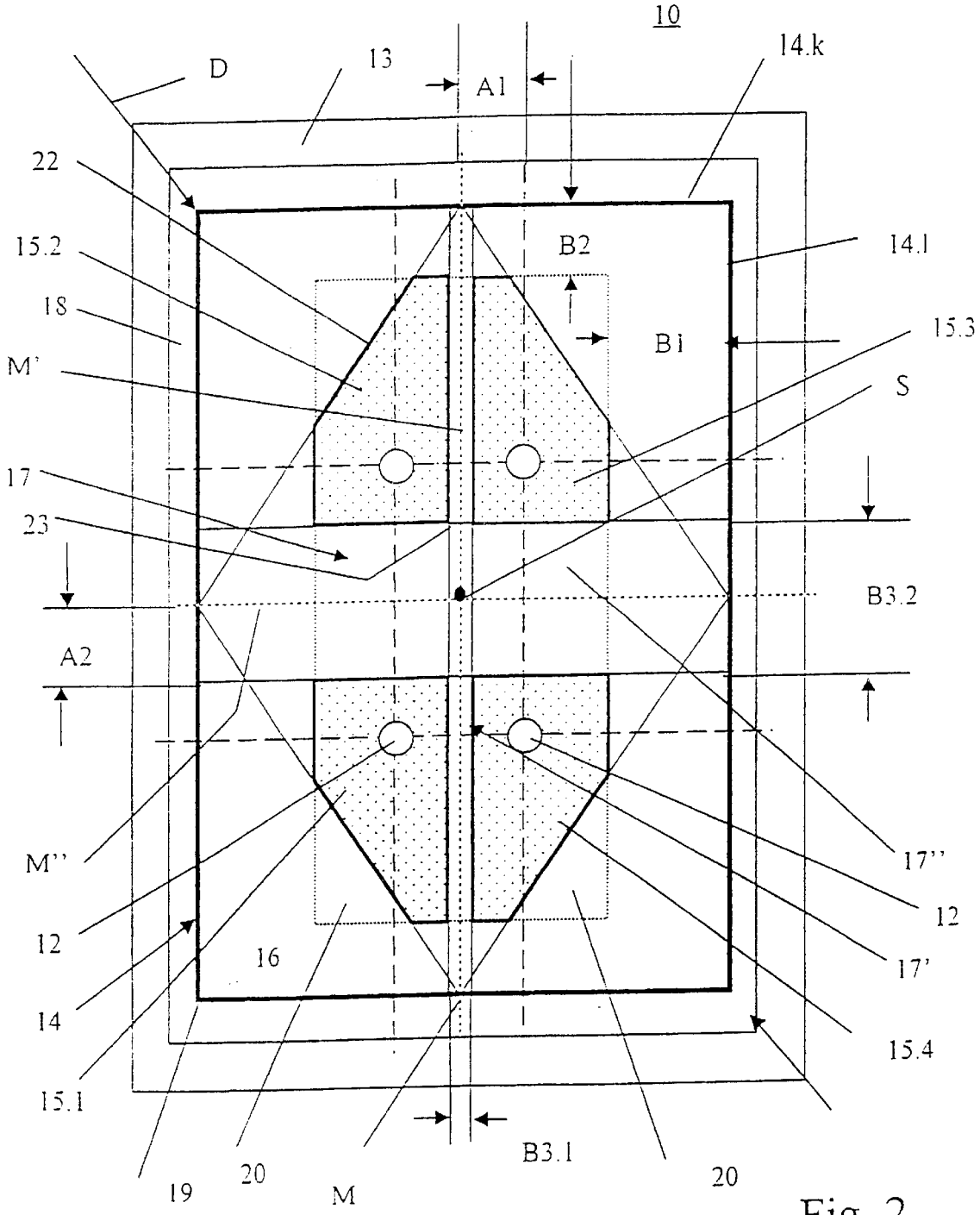
FIG. 2 another diagram according to FIG. 2.

FIG. 2 illustrates another embodiment for an optimal positioning area 15 (15.1 to 15.4). In this embodiment, the edges 14.l, 14.k of the panel are connected with the frame 13 by elastic elements 18. It should be noted that the type of connection between the frame 13 and the panel 11 does not have a significant impact on the optimal positioning of the drivers 12 on the panel 11, so that the conditions shown in the embodiment of FIG. 1 apply essentially also to the panel loudspeaker 10 of FIG. 2, and vice versa.

According to FIG. 2, the edge area 16 does not have a uniform width B. Instead, the edge areas 16 that extend parallel to the long edges 14.l have a width B1 that is greater than the width B2 of the edge areas 16 that extend parallel to the short edges 14.k. The different widths B1, B2 depend on the size of the panel 11 in that the width B1 is approximately 16% and the width B2 is approximately 6.3% of the diagonal D of the panel 11.

As seen from FIG. 2, the center-of-gravity area 17 is in the form of a cross, whereby two two-dimensional stripes 17', 17" each extend parallel to the edges 14, crossing at the center of gravity S of the panel 11. The width B3 (B3.1, B3.2) of the two two-dimensional stripes 17', 17" is different so as to obtain a sufficiently large positioning area 15 for the drivers 12. When referenced to the dimensions of the panel 11 and/or the edges 14.l, 14.k that have a different length due to the elongated shape of the panel 11, the width B3.2 of the two-dimensional stripe 17' that extends parallel to the long edge 14.l is 2.9% and the width B3.1 of the other two-dimensional stripe 17" is 17.4% of the diagonal D of the panel 11.

The intersecting two-dimensional stripes 17', 17" in conjunction with the edge area 16 produce four positioning areas 15.1–15.4 where drivers 12 can be placed with advantageous results. However, if drivers 12 are placed in the areas of the basic positioning areas 15.1–15.4 proximate to the corners 19, where a respective short edge 14.k intersects with a long edge 14.l, then the transfer of bending waves to the panel 11 deteriorates considerably due to the proximity to the edge 19. For this reason, each positioning area 15.1–15.4 includes a triangular reduction 20. Two respective sides of each reduction 20 are formed by the inner edges 21 of the edge area 16. The third sides of the triangular reductions 20 are located on a line 22 which—as shown in FIG. 2—connects the centers M of all the edges 14 with each other. To illustrate the situation more clearly, the positioning areas 15.1–15.4 in FIG. 2 that are reduced in size by the reductions 20 are also shown as dotted areas. Even if the positioning of the drivers 12 in the dotted positioning areas can be viewed as optimal, it has been observed that a further optimization can be attained by arranging drivers 12 in the regions of the positioning areas 15.1–15.4 which are located proximate to the corners 23 that face the center of gravity inside the positioning areas 15.1–15.4. This means with reference to the geometry of the panel 11 that the regions inside the positioning areas 15.1–15.2 have a different distance A1, A2 to the center lines M', M" which intersect in the center of gravity and also extend parallel to the long and short edges 14.l, 14.k. In the embodiment depicted in FIG. 2, the distance A1 between the drivers 12 and the center line M' is 6.9% and the distance A2 between the drivers 12 and the center line M" is 14% of the diagonal D of panel 11. Although all the drivers 12 in the embodiment of FIG. 2 satisfy the conditions with respect to their respective distance from the center lines M', M", these conditions do not have to be satisfied for all drivers 12 in another possible embodiment (not shown). For example, it may be sufficient if only two of the drivers 12 satisfy the distance relationship, whereas the other drivers 12 are located inside the dotted positioning areas 15.1–15.4. It may also not be necessary to orient all drivers 12 symmetrically with respect to each other inside the positioning areas 15.1–15.4.

We claim:

1. Panel loudspeaker comprising:

a panel, which includes a plurality of edges, a center-of-gravity area centered on a center of gravity of the panel, the center-of-gravity area having a diameter of at least 25% of a diagonal of the panel, an edge area abutting the plurality of edges and extending towards the center of gravity of the panel, and a positioning area extending between the edge area and the center-of-gravity area, at least one driver, and a frame connected to the panel, wherein the at least one driver is connected to the panel only inside the positioning area.

2. Panel loudspeaker according to claim 1, wherein the panel is fixedly clamped in the frame and the edge area of the panel has a width that is at least 5% of a diagonal of the panel.

3. Panel loudspeaker according to claim 1, wherein the panel is yieldably connected to the frame, and wherein the center-of-gravity area is a cross-shaped two-dimensional area and formed by two mutually perpendicular two-dimensional stripes that extend through the center of gravity of the panel and connect the respective edge area by a shortest possible distance.

4. Panel loudspeaker according to claim 3, wherein the cross-shaped center-of-gravity area defines four positioning areas which each include a reduction proximate to an area where two respective intersecting edges of the panel form a corner.

5. Panel loudspeaker according to claim 4, wherein the respective reductions of the positioning areas have a triangular shape, wherein two sides of each triangular-shaped reduction are formed by respective inner edges of the edge area and the remaining side of each triangular reduction is formed by a closed continuous line that connects respective centers of intersecting edges.

6. Panel loudspeaker according to claim 2, wherein the panel has a rectangular shape, wherein two intersecting edges of the panel that form a corner have a different length, and wherein a portion of the edge area that abuts an edge of the panel with one length has a different width than a portion of the edge area that abuts an edge of the panel with another length.

7. Panel loudspeaker according to claim 6, wherein a first width of the edge area which abuts a long edge of the panel, is a greater than a second width of the edge area which abuts a short edge of the panel.

8. Panel loudspeaker according to claim 7, wherein the first width is at least 10% and the second width is at least 5% of the diagonal of the panel.

9. Panel loudspeaker according to claim 3, wherein the two two-dimensional areas that cross one another have a different width.

10. Panel loudspeaker according to claim 6, the two two-dimensional areas that cross one another have a different width, with a width of the two-dimensional area extending parallel to a long edge of the panel is greater than or equal to 2.5% and a width of the two-dimensional area extending parallel to a short edge of the panel is greater than or equal to 17% of the diagonal of the panel.

11. Panel loudspeaker according to claim 6, wherein the at least one driver maintains a first distance to a center line that extends parallel to a long edge of the panel and a second distance to a center line that extends parallel to a short edge of the panel, with the center lines intersecting at the center of gravity, wherein the first distance is smaller than the second distance.

12. Panel loudspeaker according to claim 11, wherein the first distance is approximately 7% and the second distance is approximately 14% of the diagonal of the panel.

13. Panel loudspeaker according to claim 1, wherein the panel has a rectangular shape.

14. Panel loudspeaker according to claim 13, wherein a first width of the edge area which abuts a long edge of the panel, is a greater than a second width of the edge area which abuts a short edge of the panel.

15. Panel loudspeaker according to claim 14, wherein the first width is at least 10% and the second width is at least 5% of the diagonal of the panel.

16. Panel loudspeaker according to claim 13, wherein the center-of-gravity area is a cross-shaped two-dimensional area and formed by two mutually perpendicular two-dimensional stripes that extend through the center of gravity of the panel and connect the respective edge area by a shortest possible distance, the two two-dimensional areas that cross one another have different widths, and a width of the two-dimensional area extending parallel to a long edge of the panel is greater than or equal to 2.5% and a width of the two-dimensional area extending parallel to a short edge of the panel is greater than or equal to 17% of the diagonal of the panel.

17. Panel loudspeaker according to claim 13, wherein the at least one driver maintains a first distance to a center line that extends parallel to a long edge of the panel and a second distance to a center line that extends parallel to a short edge of the panel, with the center lines intersecting at the center of gravity, wherein the first distance is smaller than the second distance.

18. Panel loudspeaker according to claim 17, wherein the first distance is approximately 7% and the second distance is approximately 14% of the diagonal of the panel.

19. Panel loudspeaker according to claim 1, wherein the panel has four edges.

20. Panel loudspeaker according to claim 1, wherein two intersecting edges of the panel that form a corner of the panel have different lengths.

21. A panel loudspeaker, comprising:

a frame;

a panel connected to the frame, the panel including:

a plurality of panel edges defining a shape of the panel;

a center of gravity;

an inner exclusion area, centered on the center of gravity of the panel and defined by exclusion-area edges, the shape of the inner exclusion area being the same as the shape of the panel, each edge of the exclusion-area edge corresponding to a different panel edge and having a length least 25% of the length of the corresponding panel edge;

an outer exclusion area abutting the plurality of panel edges and extending towards the center of gravity of the panel; and a positioning area extending between the outer exclusion area and the inner exclusion area; and a driver connected to the panel inside the positioning area.

22. A panel loudspeaker as set forth in claim 21, wherein the panel is fixedly clamped in the frame.

* * * * *

UNITED STATES PATENT AND TRADEMARK OFFICE

CERTIFICATE OF CORRECTION

PATENT NO. : 6,836,552 B1
DATED : December 28, 2004
INVENTOR(S) : Wolfgang Bachmann et al.

It is certified that error appears in the above-identified patent and that said Letters Patent is hereby corrected as shown below:

Column 3,
Line 35, replace "according to FIG. 2." with -- according to FIG. 1. --.

Column 7,
Line 12, delete "edge of the".

Column 8,
Line 1, insert -- at -- after "length".

Signed and Sealed this

Eighth Day of March, 2005

JON W. DUDAS
*Director of the United States Patent and Trademark Office*